United States Patent [19]

Nemet

[11] Patent Number: 4,543,581

[45] Date of Patent: Sep. 24, 1985

[54] ANTENNA ARRANGEMENT FOR PERSONAL RADIO TRANSCEIVERS

[75] Inventor: Mihaly Nemet, Budapest, Hungary

[73] Assignee: Budapesti Rádiótechnikai Gyár, Hungary

[21] Appl. No.: 394,837

[22] Filed: Jul. 2, 1982

[30] Foreign Application Priority Data

Jul. 10, 1981 [HU] Hungary ..... 2039/81

[51] Int. Cl.[4] ..... H01Q 1/24

[52] U.S. Cl. ..... 343/702; 343/805

[58] Field of Search ..... 343/702, 752, 749, 793, 343/794, 805; 455/82, 83, 89-129, 351, 274, 278

[56] References Cited

U.S. PATENT DOCUMENTS

| | | | |
|---|---|---|---|
| 1,766,047 | 6/1930 | Taylor | 455/129 |
| 2,753,557 | 7/1956 | Middlemark | 343/702 |
| 2,875,443 | 2/1959 | Kandoian | 343/749 |
| 3,020,548 | 2/1962 | Jacobson et al. | 455/274 |
| 3,323,129 | 5/1967 | Held | 455/274 |
| 3,579,241 | 5/1971 | Antista | 343/805 |
| 3,969,673 | 7/1976 | Nordlof | 455/89 |
| 4,138,681 | 2/1979 | Davidson et al. | 343/844 |
| 4,223,314 | 9/1980 | Tyrey et al. | 343/749 |
| 4,396,920 | 8/1983 | Grimberg et al. | 343/752 |

FOREIGN PATENT DOCUMENTS

| | | | |
|---|---|---|---|
| 219580 | 8/1958 | Australia | 343/805 |
| 468629 | 11/1928 | Fed. Rep. of Germany | 455/129 |
| 122201 | 9/1927 | Switzerland | 343/846 |
| 2036447 | 6/1980 | United Kingdom | 343/846 |

*Primary Examiner*—Eli Lieberman
*Assistant Examiner*—K. Ohralik
*Attorney, Agent, or Firm*—McGlew and Tuttle

[57] ABSTRACT

An antenna arrangement for personal radio transceivers in which a main antenna extends from the housing of the transceiver which is excited by a high frequency connector thereof, includes an auxiliary antenna which is coupled to a cold terminal of the connector to form a counterweight for the main antenna. Both the main and auxiliary antennas are resonant and shorter than the quarterwavelength, whereby the housing is placed at a potential minimum and the effects of the close presence of a human body on radiational properties for the arrangement will be reduced.

8 Claims, 15 Drawing Figures

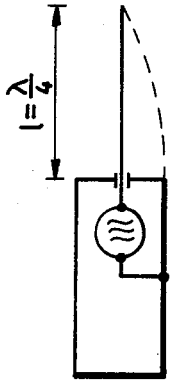
Fig.1
Prior Art
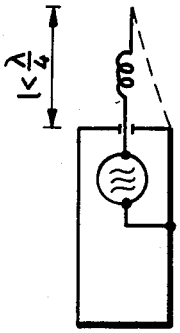
Fig.2
Prior Art
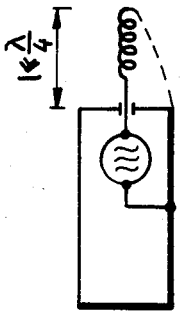
Fig.3
Prior Art
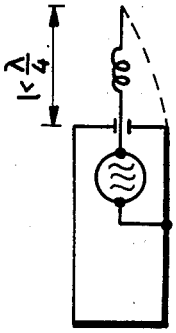
Fig.4
Prior Art
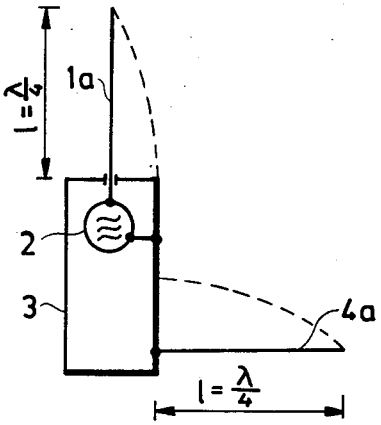
Fig. 6.a
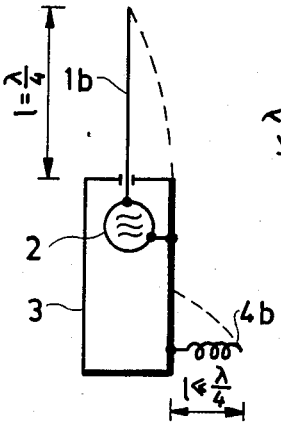
Fig. 6.b
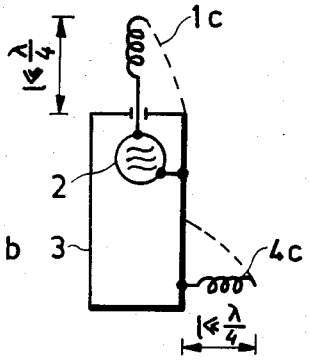
Fig. 6.c
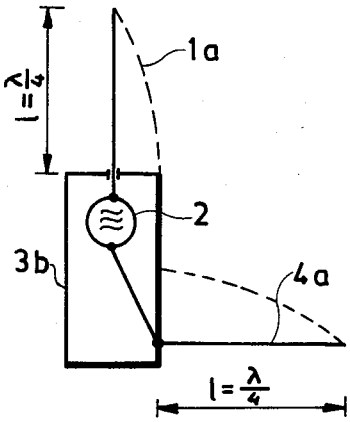
Fig. 6.d
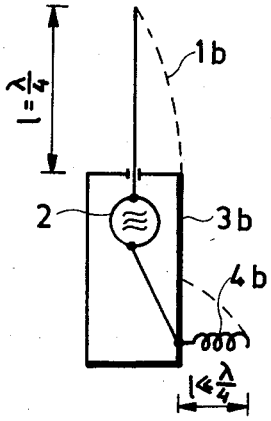
Fig. 6.e
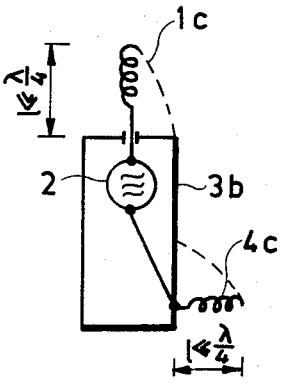
Fig. 6.f

ANTENNA ARRANGEMENT FOR PERSONAL RADIO TRANSCEIVERS

FIELD AND BACKGROUND OF THE INVENTION

The invention relates to an antenna arrangement for personal radio tranceivers, in which the transceiver is connected to a resonant antenna which is shorter than a quarterwavelength of radio signals to be sent and received.

The term "personal radio transceiver" designates a portable radio transmitter and receiver set which has a battery supply, its operational frequency falls in the VHF or UHF band and the maximum high frequency output power is below 5 W. In operation the set is held in hand closely to the human body and the antenna of the set is connected directly to the housing of the transceiver.

The design of personal transceivers is always a compromise between several mutually conflicting requirements. In view of its handling it is preferable if the set has small dimensions and weight, however, with small weight and size the output power and the maximum operating time is decreased. The operating time is determined by the output power and the useful life of the battery supply. The size and design of the antenna can significantly determine the performance of such transceivers. In personal radio transceivers the effective radiation of the available high frequency power is rather problematic due to the vicinity of the human body, therefore the design of the antenna is a decisive factor regarding the operational properties of the transceiver.

If the properties of personal radio transceivers are compared to the radiational properties of a quarterwave vertical whip antenna which is arranged on a sufficiently large metal surface, it will be observed that, with identical output power, the established electromagnetic field of such transceivers will be about 10 dB smaller than for the whip antenna.

In the paper by N. H. Sheperd and W. G. Chaney entitled "Personal Radio Antennas" /IRE Trans. Vehicular Comm. Vol. VC-10 pp. 23-31, April 1961/ the results of measurements carried out by various types of "small" antennas are summarized. Here the conclusion has been drawn that the quarterwave whip antenna is the most favourable and it has an attenuation of about 10 dB compared to the ideal antenna with 0 dB gain. The various other types of shortened antennas were by 3 to 10 dB worse than this quarterwave whip.

In addition to the problem of attenuation there is a further problem with such "short" antennas i.e. the fluctuation of the field strength during operation caused by the varying relative position of the set and of the human body. The extent of such fluctuation can be about 5 dB.

The small effectivity of radiation which is below 10% can be explained by the fact that the housing of the transceiver has a size which is negligably small compared to the wavelength, thus it can not act as a counterweight for the radiating antenna. From this it follows that a portion of the antenna current will flow through the hand which supports the set, into the human body which has a small conductivity, and the corresponding power is dissipated. The presence of the human body increases the base point impedance and decreases the current of the antenna.

When the human body is close to the voltage maximum of the radiating antenna, then the established electrical coupling might de-tune the antenna, can also change its impedance and in addition to the radiation losses caused by the presence of the body, mismatching losses will occur. This latter effect is particularly significant in the so called miniature antennas built of a helical radiator of normal mode of radiation, because such antennas get very close to the human body during operation and the detuning effect of the body can therefore be excessive. This is a rather serious problem because the reactance steepness of the base point impedance of such shortened antennas are rather high and when detuning takes place, the mismatching losses will be substantial.

In addition to the above sketched problems a further problem lies in the shielding effect of the human body which can only be decreased by raising the height of the antenna. This latter is conflicting, however, with the demand of miniaturization and of comfortable handling.

SUMMARY OF THE INVENTION

The object of the invention is to provide an antenna arrangement for personal radio transceivers which can substantially reduce the disadvantegous effects of the proximity of the human body to such device and thereby increase their performance.

The invention is based on the recognition that the above summarized problems rooted in that the housing of the transceiver was used as a counterweight to the antenna, and the problems can well be eliminated if an auxiliary antenna is used which is capable of changing the current distribution of the whole radiating system in such a manner that a potential minimum occurs at the region of the housing.

According to the invention a high frequency connector on or in the housing of the transceiver is coupled with its "warm" terminalto the main antenna and the other "cold" terminal is electrically connected with a resonant auxiliary antenna which is shorter than the quarterwavelength and acts as a counterweight to the main antenna. The term "shorter than the quarterwavelength" is used in the sense that the linear size of the antenna can be at most as long as the quarterwavelength of the operational frequency measured in the free space.

It is preferable if the axis of the auxiliary antenna makes an angle with the main antenna which is between about 90° and 180°, and if the two antennas are arranged in respective opposing end regions of the housing.

It is advantageous for the handling of the transceiver if the auxiliary antenna, and in given cases also the main antenna, is coupled through a pivoted joint to the housing that allows the adjustment of its angular direction.

The housing of the transceiver can be made of an electrically conductive or non-conductive material, but in the latter case a separate electrical conductor should connect the auxiliary antenna with the high frequency connector.

According to the invention an improved resonant antenna has also been provided for personal radio transceivers which comprises a linear electrical conductor extending out from the antenna base and a helical section with normal mode of radiation coupled to the outer end of the conductor, in which the length of the linear conductor is at least half of the full antenna length but preferably it is equal to two-thirds thereof or even greater.

The so-constructed antenna can be used both as auxiliary and main antenna, and its advantage lies in that it can provide an increased electrical moment and the helical section, which is responsible for the establishment of the electrical field, is placed far from the antenna base and from the human body, whereby the losses due to detuning, shielding and mismatching will be reduced.

BRIEF DESCRIPTION OF THE DRAWINGS

The invention will now be described in connection with preferable embodiments thereof in which reference will be made to the accompanying drawings. In the drawing:

FIGS. 1 to 4 show various known antenna-transceiver arrangements;

Figure 5:
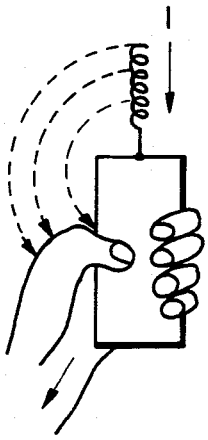
Fig. 5 Prior Art
FIG. 5 illustrates the path of current flowing into the human body in known arrangements.
Figure 7:
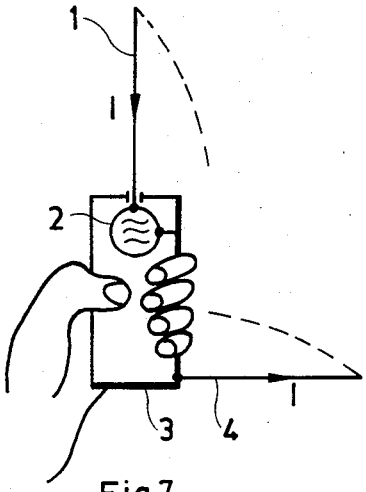
Figure 8:
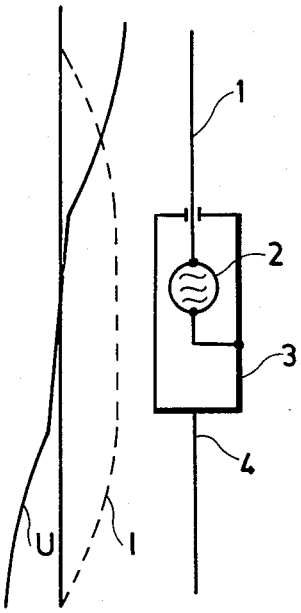
Figure 9:
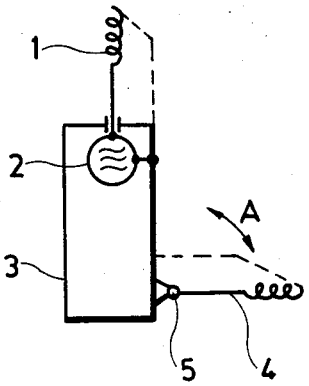
Figure 10:
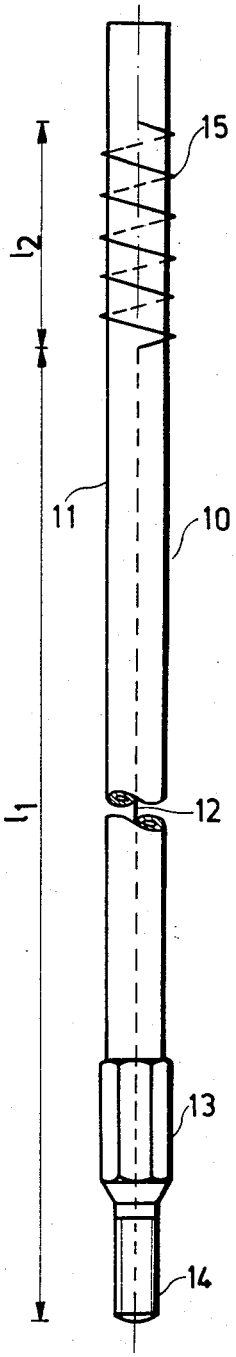

FIGS. *6a* to *6f* show various embodiments of the antenna arrangement according to the invention;

FIG. 7 is an illustration similar to FIG. 5 in the case of using the antenna arrangement according to the invention;

FIG. 8 shows the current and voltage distribution of the antenna arrangement according to the invention;

FIG. 9 shows the antenna according to the invention used in the antenna arrangement suggested according to the invention, and FIG. 10 is an enlarged view of the antenna sketched in FIG. 9 with its cover removed.

DESCRIPTION OF THE PREFERRED EMBODIMENTS

FIGS. 1 to 5 illustrate the main types of conventional antennas used for personal radio transceivers. FIG. 1 shows a quarterwave resonant whip antenna. Such an antenna is used mainly together with transceivers operated above 100 MHz, because in case of lower frequencies the rod will be inconveniently long. FIG. 2 shows a rod antenna tuned to resonance by a coil inserted in the antenna base and the length of this structure is shorter than the quarterwavelength. FIG. 3 shows a helical antenna with normal mode of radiation which is substantially shorter than the quarterwavelength.

FIG. 4 shows an inductively loaded antenna which is also shorter than the quarterwave. In FIGS. 1 to 4 the dash line beside the antenna indicates the current distribution.

FIG. 5 shows the common drawback of the four above described known antennas, which lies in that owing to the effect of the hand and the body of the operator, the current distribution will be changed in the close vicinity of the transceiver and of the antenna, which results in that only a small fragment of the displacement current can flow back to the housing of the transceiver (i.e. the housing can not act as a balance for the antenna), and the remaining dominant part of the current flows to the human body where it is disspated there and this part can not contribute to the establishment of the radiated electromagnetic field. This explains why in the above described transceivers only about 10% of the full transmitted power will be radiated in the form of electromagnetic waves.

The disturbing effect of the human body will be more intensive if the voltage maximum gets closer to the body, and for that reason the antenna shown in FIG. 3 is particularly disadvantageous. This drawback is more serious if it is considered that such antennas become detuned by the proximity of the body, and their efficiency is further decreased by the resulting mismatching losses. FIGS. *6a*, *6b*, . . . , *6f* show various embodiments of the antenna structures according to the present invention. The difference compared to the conventional antennas show in FIGS. 1 to 4 lies in the use of an auxiliary antenna 4 which is coupled to housing 3 as in FIGS. *6a*, *6b* and *6c*, or to a "cold" or ground terminal of generator 2 designating the transceiver as in FIGS. *6d*, *6e* and *6f*. Similarly to the main antenna 1 the auxiliary antenna 4 is a resonant quarterwave beam which can have any suitable form. The optional design of the auxiliary antenna 4 means that the antenna 4 can be any of the types shown in FIGS. 1 to 4 or any other short asymmetrical aerial which has similar radiation properties. Generator 2 is a high-frequency transmitter and receiver having a high-frequency or "warm" port for connection to antenna 1.

FIGS. *6a* to *6f* illustrate different kinds of mutual arrangements of the transceiver and of its main and auxiliary antennas although other structures might equally be useful. In FIGS. *6a* and *6d* the main antenna 1*a* and the auxiliary antenna 4*a* are both formed by respective quarterwave rods. In FIGS. *6b* and *6e* the main antenna 1*b* is again a quarterwave rod, but the auxiliary antenna 4*b* is a resonant helical radiator with normal mode of radiation with a length substantially shorter than the quarterwave. In FIGS. *6c* and *6f* both the main antenna 1*c* and the auxiliary antenna 4*c* are formed by respective resonant helixes with normal modes of radiation.

The dashed lines in FIGS. *6a* to *6f* show the current distribution along the length of the antennas. It can be observed that the maximum current is at the antenna base i.e. directly at the output or "warm" terminal of the generator 2. It can also be observed in FIG. 6 that the auxiliary antenna 4 extends laterally out of the housing 3 at the lower end portion thereof which is opposite to the other end from which the main antenna 1 extends out vertically. The main antenna 1 is isolated from the housing 3 as shown in FIGS. *6a* to *6f*. The lateral positioning of the auxiliary antenna 4 is preferable in view of the handling of the transceiver and this lateral arrangement exerts substantially no influence on the radiation properties, or the effect thereof results in a more uniform distribution of the field strength, since the sensibility will change moderately when the plane of polarization changes. The angular position of the auxiliary antenna 4 relative to the main antenna 1 can take any value between 90° and 180°.

The operation and the effects of the arrangement according to the invention will be described with reference to FIGS. 7 and 8. FIG. 7 shows the arrangement of FIG. *6a* when the transceiver is held in the hand in the operational position. The main antenna 1 is resonant and the current I has a nearly sinusoidal distribution along the antenna length with a maximum at the antenna base. The auxiliary antenna 4 is also resonant and represents a much lower impedance than the hand that supports the device, therefore the dominant part of the antenna current will not flow any more from the housing 3 to the human body but rather to the auxiliary antenna 4, along which a sinusoidal distribution will be established.

FIG. 8 shows both the current and voltage distribution if the axes of both the main and auxiliary antennas 1 and 4 fall in a common line. It can be observed in FIG.

8 that along the housing 3 of the transceiver (if it is made of a metal) or along the electrically conducting wire leading to the auxiliary antenna 4 if the housing is made of a non-conducting material, a uniform maximum current will flow, therefore the housing 3 will also be utilized for the establishment of the radiated electromagnetic field. There is a voltage minimum along the housing 3, therefore the hand holding the set can not cause a significant distorsion of the generated field (due to the fact that the conductivity of the hand is much smaller than that of the housing). The coupling between the human body and the transceiver will therefore be reduced, which reduces the danger of the antenna being detuned when the set is held the hand. This means that the matching of the antenna can be made more accurately which will not be influenced any more by the way the hand supports the housing, therefore the mismatching losses due to the presence of the supporting hand will be eliminated.

The auxiliary antenna will also be used for radiating and its electromagnetic field will strengthen that of the main antenna 1. If the auxiliary antenna 4 is arranged laterally, it will have a horizontal plane of polarization, and in those sites, e.g. in reception mode, the which a vertical antenna can hardly receive signals due to polarization turning properties of the terrain, the reception is made possible by the horizontal auxiliary antenna 4.

Owing to the presence of the auxiliary antenna 4, the base impedance of the main antenna 1 will be smaller and the antenna current will be higher. The decrease of the base impedance results in an increase in the effectivity of the antenna. Of course, the high-frequency circuits of the transceiver i.e. the power output stage of the transmitter part and the input stage of the receiver part should be matched to this decreased base impedance, which can be realized by the application of known matching members.

According to experimental measurements carried out with transceivers with the proposed antenna arrangement the increase in effectivity is about four times compared to the conventional arrangements shown in FIGS. 1 to 4. This means that with identical circumstances the transceiver equipped with an auxiliary antenna provides a field which is about 6 dB higher in transmission mode and has a 6 dB better sensitivity in reception mode compared to transceivers having no auxiliary antenna. The actual improvement during usage is still higher, because the losses caused by the varying detuning effects in various relative positions of the body and the transceiver will not prevail any more and the level of random fluctuations of the field strength or sensitivity due to different shielding effects of the body will also be reduced.

Such an improvement in the performance of the transceiver results in that with a given output power the device can be considered to belong to a higher power category, or with a given performance the device can be operated with less power in a smaller housing and it will have a longer operational time with a battery.

It is preferabe if the auxiliary antenna 4 is releasably coupled to the housing 3. With removed auxiliary antenna 4 the established field strength is reduced and the receptional sensitivity will also worsen. This decreased performance might be preferable when the radio traffic should be limited to short distance connections. This can be explained by the well-known fact that in order to decrease the interferences in the available frequency bands the connections should be established always on or about the minimum sufficient power level. If a higher power is required, the demand can easily be met by the operational application of the auxiliary antenna.

According to the above described properties, the application of the auxiliary antenna can substantially reduce the size of the transceiver required to a given effective output power, or with given sizes it can provide a substantially longer operational time from the battery for the transceiver.

It can be understood that the beneficial effects of the auxiliary antenna 4 occur in full extent only if the generator 2 is matched to the decreased base impedance of the antenna. Practical tests showed, however, that the application of the auxiliary antenna, when connected simply to conventional transceivers of the types shown in FIGS. 1 to 4 without any special impedance matching, resulted in an improvement between about 3–4 dB.

Reference is made finally to FIGS. 9 and 10 in which an antenna construction is illustrated which can be used both a main and an auxiliary antenna. This design comprises a linear section with a length $l_1$ and a helical portion with normal radiation mode connected to the upper end of the first section with a length $l_2$, and the combined length of the two sections is substantially shorter then the quarterwave (about one tenth thereof). It can be seen from the current distribution shown in FIG. 9 that along the comparatively long linear section a substantially uniform and high current flows, and the electrical moment of such an antenna is high, and it is even higher than the moment of the antenna shown in FIG. 4. An additional advantage lies in that the voltage is low along the linear section. If the transceiver shown in FIG. 9 is moved during transmission to a position close to the head of the operator, e.g. to speak directly into the microphone, then the helical section of the antenna which is most critical for the establishment of the radiation will be disposed above the head, thus the detuning and covering effects of the human body will be reduced. There are therfore a number of effects which explain the high efficiency of this antenna.

FIG. 9 shows that the auxiliary antenna 4 is coupled through a pivot 5 to the housing 3, and it can be turned in and out around the pivot 5 as indicated by arrow A. This pivotal design is preferable, since when the transceiver is switched off or if it is set to short distance connections, then the auxiliary antenna can be turned in closely to the housing 3 and its presence cannot even be noticed. If the rim of the housing 3 comprises a suitable shoulder or defines a recess, then in its upwardly turned position the auxiliary antenna does not extend out of the outline of the housing 3.

FIG. 10 shows the structural design of the antenna of FIG. 9 in detail and with removed outer protectional covering layer. The antenna 10 has a central body formed by a plastic tube 11, in which a linear conductor 12 is arranged. The lower end portion of the tube 11 is fixed in the upper bore of a connector body 13. The connector body 11 has a threaded lower end 14 to enable the fixing of the body 11 in a threaded socket mounted in the housing 3. The end 14 has a tubular design and the conductor 12 is passed therethrough and it is fixed to the bottom of the end 14 by a soldered connection.

The spiral 15, which forms the helical radiator, is mounted tightly on the mantle surface of the tube 11 and its lower end is connected to the conductor 12.

The antenna 10 is covered and protected by the application of a covering tube made of a thermoshrinking plastic material. After a suitable heating of the tube (not shown in FIG. 10), it will shrink and the arrangement of FIG. 10 will form a single covered unit from which only the threaded end 14 can be seen separately as it extends out of the lower end of the tube.

I claim:

1. A hand-held personal radio transceiver and antenna combination comprising:

(a) a housing (3) made of conductive material and adapted to be held in a user's hand when in use;

(b) a high-frequency transmitter and receiver (2) in said housing having a warm terminal for transmitting and receiving high-frequency signals, and a cold terminal, said warm terminal being isolated from said conductive material of said housing;

high-frequency connector means for connecting said conductive material to said cold terminal;

a resonant main antenna (1) which is shorter than the quarterwave of signals to be transmitted and received by said high-frequency transmitter and receiver, said main antenna connected to said warm terminal and extending out from one end of said housing;

isolating means connected between said main antenna and said housing for isolating said main antenna from said conductive material of said housing; and a resonant auxiliary antenna (4) which is shorter than the quarterwavelength, pivotally connected to said conductive material of said housing at a location remote from said end of said housing for establishing an electrical counterpoise to said main antenna, said auxiliary antenna extending at an angle of from 90° to 180° with respect to said main antenna.

2. The combination of claim 1, wherein both of said main and auxiliary antennas are linear antennas, said auxiliary antenna being pivotally mounted to said housing.

3. The combination of claim 1, wherein said auxiliary antenna (4) is pivotally mounted to a side wall of said housing (3).

4. The combination of claim 3 wherein said auxiliary antenna (4) extends substantially normally to said main antenna (1) during use.

5. The combination of claim 1, wherein at least one of said main and auxiliary antennas includes a coiled portion.

6. The combination of claim 5, wherein said at least one of said main and auxiliary antennas includes a linear section connected to said coil portion.

7. The combination of claim 1, wherein said main antenna (1) extends upwardly from a top end of said housing (3) and said auxiliary antenna (4) extends from a side wall of said housing, near a bottom end of said housing.

8. The combination of calim 7, wherein said auxiliary antenna (4) extends substantially normal to said main antenna (1).

* * * * *